United States Patent [19]

Naito et al.

[11] Patent Number: 4,463,079

[45] Date of Patent: Jul. 31, 1984

[54] HEAT DEVELOPABLE COLOR PHOTOGRAPHIC MATERIALS WITH REDOX DYE RELEASERS

[75] Inventors: Hideki Naito; Hiroshi Hara; Kozo Sato, all of Kanagawa, Japan

[73] Assignee: Fuji Photo Film Co., Ltd., Kanagawa, Japan

[21] Appl. No.: 373,546

[22] Filed: Apr. 30, 1982

[30] Foreign Application Priority Data

Apr. 30, 1981 [JP] Japan ..... 56-65391

[51] Int. Cl.[3] ..... G03C 1/40; G03C 5/54; G03C 7/00

[52] U.S. Cl. ..... 430/203; 430/223; 430/351; 430/559; 430/619

[58] Field of Search ..... 430/203, 223, 351, 619, 430/559, 617, 618

[56] References Cited

U.S. PATENT DOCUMENTS

| | | | |
|---|---|---|---|
| 3,761,270 | 9/1973 | de Mauriac et al. | 430/351 |
| 4,021,240 | 5/1977 | Cerquone et al. | 430/203 |
| 4,022,617 | 5/1977 | McGuckin | 430/203 |

FOREIGN PATENT DOCUMENTS

| | | | |
|---|---|---|---|
| 2058383 | 4/1981 | United Kingdom | 430/617 |

OTHER PUBLICATIONS

"Positive Images in Photothermographic Materials", Kohrt, *Research Disclosure,* No. 16408, 12/77, pp. 15 & 16.

*Primary Examiner*—Richard L. Schilling
*Attorney, Agent, or Firm*—Sughrue, Mion, Zinn, Macpeak and Seas

[57] ABSTRACT

A diffusion transfer heat-developable color photographic material. The material comprises a support, a photosensitive silver halide, an organic silver salt, a hydrophobic binder, a dye releasing activator, and a dye releasing redox compound which releases a diffusible dye. Color images are obtained with the material by transferring a dye released by heat development. The material makes it possible to obtain clear color images by a simple procedure and the images obtained are stable over a long period of time.

15 Claims, No Drawings

HEAT DEVELOPABLE COLOR PHOTOGRAPHIC MATERIALS WITH REDOX DYE RELEASERS

FIELD OF THE INVENTION

The present invention relates to heat-developable color photographic materials which form color images by heat development. Particularly, the present invention relates to novel heat-developable color photographic materials containing a dye releasing redox compound which releases a diffusible dye by heat development. Particularly, the present invention relates to novel heat-developable color photographic materials by which color images are obtained by transferring the dye released by heat development.

BACKGROUND OF THE INVENTION

Photographic processes using silver halide have been most widely used hitherto because they are excellent in photographic properties such as sensitivity or control of gradation, etc. as compared with other photographic processes, for example, an electrophotographic process or a diazo photographic process. In the recent years, with respect to the image formation process for the photographic materials using silver halide, many techniques capable of obtaining images ease and rapidly have been developed by changing the conventional wet process using a developing solution into a dry process such as heating, etc.

The heat-developable photographic materials are known in the field of these technique, and the heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure* No. 17029, p.p. 9 to 15 (June, 1978).

As processes for obtaining color images, many processes have been proposed. With respect to processes for forming color images by the reaction of an oxidation product of a developing agent with coupler, it has been proposed to use a p-phenylenediamine type reducing agent and phenolic coupler or active methylene coupler as described in U.S. Pat. No. 3,531,286, p-aminophenol type reducing agent as described in U.S. Pat. No. 3,761,270, sulfonamidophenol type reducing agent as described in Belgium Pat. No. 802,519 and *Research Disclosure,* p.p. 31 and 32 (September, 1975) and combinations of sulfonamidephenol type reducing agent and 4-equivalent coupler as described in U.S. Pat. No. 4,021,240. These processes, however, have a disadvantage in that color images formed are turbid, because a reduced silver image and a color image are formed at the same time on the exposed area after heat development. Examples of method designed to eliminate this drawback are a process which comprises removing the silver images by liquid processing, for example, a bleach-fix processing, or a process which comprises transferring only dyes to a sheet having another layer, for example, an image receiving layer. However, this process is not desirable because it is not easy to transfer only the dyes by distinguishing them from unreacted substances.

Another known process comprises introducing a nitrogen containing heterocyclic group into dyes, forming silver salts and releasing the dyes by heat development. This process is described in *Research Disclosure* No. 16966, p.p. 54 to 58 (May, 1978). According to this process, clear images can not be obtained, because it is difficult to control the release of the dyes from unexposed areas, and thus it is not a conventional process.

With respect to another known process for forming positive color images by a thermal silver-dye bleach process, useful dyes and a means for bleaching have been described in *Research Disclosure* No. 14433, p.p. 30 to 32 (April, 1976), and No. 15227, p.p. 14 to 15 (December, 1976), and U.S. Pat. No. 4,235,957. However, this process requires an additional step and an additional material for accelerating bleaching of dyes, for example, heating with a superimposed activating agent sheet. Furthermore, the process is not desirable because the resulting color images are gradually reduced and bleached by coexisting free silver when preserved for a long period.

Still another process for forming color images which utilizing leuco dyes has been described in, for example, U.S. Pat. Nos. 3,985,565 and 4,022,617. However, this process is not desirable because it is difficult to incorporate stably the leuco dyes in the photographic materials and coloration gradually occurs during preservation.

SUMMARY OF THE INVENTION

The present invention provides a novel process for forming color image using a heat-developable color photographic material and dissolves the disadvantages in the known materials.

An object of the present invention is to provide a novel dye releasing redox compound for a heat-developable color photographic material.

Another object of the present invention is to provide a process for easily forming a color image using a novel dye releasing redox compound.

Yet another object of the present invention is to provide a process for obtaining a clear color image by a simple procedure.

Still another object of the present invention is to provide a process for obtaining a color image which are stable for a long period of time.

The above described objects of the present invention are attained by a diffusion transfer heat-developable color photographic material which comprises a support having coated thereon a layer containing at least a photosensitive silver halide, an organic silver salt, a hydrophobic binder, a dye releasing activator and a dye releasing redox compound which releases a diffusible dye upon heat development.

DETAILED DESCRIPTION OF THE INVENTION

In the heat-developable color photographic materials of the present invention, it is possible to produce a silver image having a negative-positive relationship to the original and a diffusible dye on the part corresponding to the silver image at the same time by only carrying out heat development after imagewise exposure to light. Namely, when the heat-developable color photographic materials of the present invention are imagewise exposed to light and developed by heating, an oxidation-reduction reaction is carried out between the organic silver salt and/or silver halide and the dye releasing redox compound by means of exposed photosensitive silver halide as a catalyst to form a silver image on the exposed areas. In this step, the dye releasing redox compound is oxidized by the organic silver salt and/or silver halide to form an oxidized product. This oxidized product is decomposed in the presence of a dye releasing activator and consequently the diffusible dye is released. Accordingly, the silver image and the diffusible dye are obtained on the exposed area, and a color image is obtained by transferring the diffusible dye.

The photosensitive silver halide used in the present invention is contained in an amount in the range of 0.005 mols to 5 mols and, preferably, 0.005 mols to 1.0 mol per mol of the organic silver salt.

Examples of silver halide include silver chloride, silver chlorobromide, silver chloroiodide, silver bromide, silver iodobromide, silver chloroiodobromide and silver iodide.

The silver halide has a particle size of 0.001 μm to 2 μm and, preferably, 0.001 μm to 1 μm.

The silver halide used in the present invention may be used as is. However, it may be chemically sensitized with a chemical sensitizing agent such as compounds of sulfur, selenium or tellurium, etc. or compounds of gold, platinum, palladium, rhodium or iridium, etc., a reducing agent such as tin halide, etc. or a combination thereof. The details are described in T. H. James; *The Theory of the Photographic Process,* the fourth edition, Chapter 5, p.p. 149 to 169.

The organic silver salt used in the present invention is a silver salt comparatively stable to light. The silver salt forms a silver image by reacting with the above described image forming compound or a reducing agent coexisting, if necessary, with the image forming compound, when heated to a temperature of above 80° C. and, preferably, above 100° C. in a presence of exposed silver halide.

Examples of such organic silver salts include compounds such as silver salts of organic compounds having carboxyl groups. Preferred examples include a silver salt of carboxylic acid derivatives or N containing heterocyclic compounds. More preferred examples include silver salts of aliphatic carboxylic acids and silver salts of aromatic carboxylic acids.

Preferred examples of silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver adipate, silver sebacate, silver succinate, silver acetate, silver butyrate and silver camphorate, etc. These silver salts may be substituted with halogen atoms or hydroxyl groups.

Examples of silver salts of aromatic carboxylic acids and other carboxyl group containing compounds include silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, silver salts of 3-carboxymethyl-4-methyl-4-thiazoline-2-thione and the like described in U.S. Pat. No. 3,785,830, and silver salts of thioether group containing aliphatic carboxylic acids described in U.S. Pat. No. 3,330,663, etc.

In addition, there are silver salts of mercapto group or thione group containing compounds and derivatives thereof.

Examples of them include silver salt of 3-mercapto-4-phenyl-1,2,4-triazole, silver salt of 2-mercaptobenzimidazole, silver salt of 2-mercapto-5-aminothiadiazole, silver salt of 2-mercaptobenzothiazole, silver salt of 2-(s-ethylglycolamido)benzothiazole, silver salts of thioglycolic acid described in Japanese Patent Application (OPI) No. 28221/73 (the term "OPI" as used herein refers to a "published unexamined Japanese patent application") such as silver s-alkyl thioglycolate (wherein the alkyl group has 12 to 22 carbon atoms), silver salts of dithiocarboxylic acids such as silver salt of dithioacetate, silver salts of thioamide, silver salt of 5-carboxyl-1-methyl-2-phenyl-4-thiopyridine, silver salt of mercaptotriazine, silver salt of 2-mercaptobenzoxazole, silver salt of mercaptooxadiazole, silver salts described in U.S. Pat. No. 4,123,274, for example, 1,2,4-mercaptotriazole derivatives such as silver salt of 3-amino-5-benzylthio-1,2,4-triazole, and silver salts of thione compounds such as silver salt of 3-(2-carboxyethyl)-4-methyl-4-thiazoline-2-thione described in U.S. Pat. No. 3,301,678.

Further, there are silver salts of imino group containing compounds. Preferred examples of them include silver salts of benzotriazole and derivatives thereof described in Japanese Patent Publication Nos. 30270/69 and 18416/70, for example, silver salt of benzotriazole, silver salts of alkyl substituted benzotriazoles such as silver salt of methylbenzotriazole, silver salts of halogen substituted benzotriazole such as silver salt of 5-chlorobenzotriazole, and silver salts of carboimidobenzotriazoles such as silver salt of butylcarboimidobenzotriazole, silver salts of 1,2,4-triazole or 1-H-tetrazole described in U.S. Pat. No. 4,220,709, silver salt of carbazole, silver salt of saccharin, and silver salts of imidazole and imidazole derivatives.

Further, silver salts described in *Research Disclosure* No. 17029, Vol. 170 (June, 1978) and organic metal salts such as copper stearate, etc. are examples of the organic metal salt which can be used in the present invention.

The details of the heat development process under heating in the present invention are not entirely clear. However, it is believed that when the photographic material is exposed to light, a latent image is formed on photosensitive silver halide. This phenomenon has been described in T. H. James, *The Theory of the Photographic Process,* 3rd edition, p.p. 105 to 148.

When the photographic material is heated, the reducing agent, namely, the dye releasing redox compound in the case of the present invention, reduces the organic metal salt or silver halide and the organic metal salt in the presence of the latent image nuclei as the catalyst with the aid of an alkali agent released by heating to form silver or metal, while it is oxidized itself. The oxidized dye releasing redox compound is attacked by a nucleophilic reagent (which may be an alkali agent) to release a dye.

The silver halide and the organic silver salt which become starting point of development should be present within a substantially effective distance.

Therefore, it is desirable if the silver halide and the organic silver salt are present in the same layer.

The silver halide and the organic metal salt which are formed in a hydrophobic binder respectively, can be mixed prior to use in order to prepare a coating solution. It is also effective to blend both of them in a ball mill for a long period of time. Further, it is effective to use a process which comprises adding a halogen containing compound to the prepared convert the silver of the organic silver salt partially to silver halide.

Methods of preparing these silver halide and organic silver salts and the method of blending is described in *Research Disclosure* No. 17029, Japanese Patent Application (OPI) Nos. 32928/75 and 42529/76, U.S. Pat.

No. 3,700,458 incorporated herein by reference to disclose such a method, and Japanese Patent Application (OPI) Nos. 13224/74 and 17216/75.

Suitable amounts of the photosensitive silver halide and the organic silver salt which are used in the present invention are 50 mg to 10 g/m$^2$ (as a combined total amount), converted to an amount of metal silver.

The dye releasing redox compound which releases a diffusible dye used in the present invention is represented by the following formula $$R—SO_2—D \quad (I)$$

wherein R represents a reducing group capable of being oxidized by the organic silver salt, and D represents an image forming dye part.

Preferably the reducing group in the dye releasing redox compound R—$SO_2$—D has a reduction-oxidation potential to a saturation calomel electrode of 1.2 V or less measuring the polarographic half wave potential using acetonitrile as a solvent and sodium perchlorate as a base electrolyte. Preferred examples of the reducing group include the following formulae (II) to (IX).

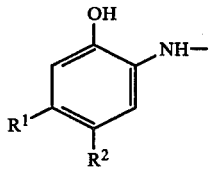
(II)

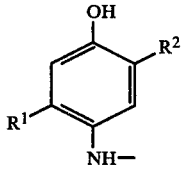
(III)

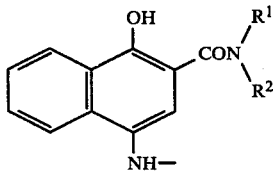
(IV)

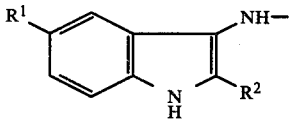
(V)

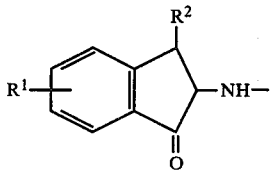
(VI)

-continued

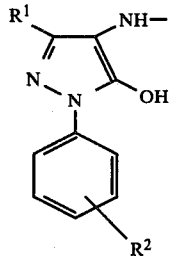
(VII)

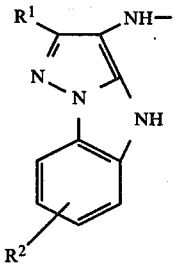
(VIII)

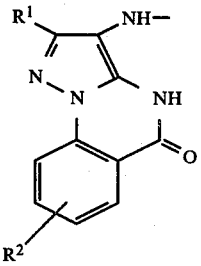
(IX)

wherein $R^1$ and $R^2$ each represents a substituent selected from the group consisting of hydrogen, an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, a N-substituted carbamoyl group or a N-substituted sulfamoyl group, which may be further substituted by a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group. The total number of the carbon atoms of substituents represented by $R_1$ and $R_2$ is preferably from 4 to 15.

Characteristics required for the reducing group R are as follows.

1. It is rapidly oxidized by the organic silver salt to effectively release a diffusible dye for image formation by the function of the dye releasing activator.
2. The reducing group R has a hydrophilic group, because it is necessary for the dye releasing redox compound to be immobilized in the hydrophobic polymer binder and that only the released dye have diffusibility.
3. It has excellent stability to heat and to the dye releasing activator and does not release the image forming dye until it is oxidized.
4. It is easily synthesized.

In the following, improved examples which satisfy the above described requirements are shown. In the example, NH— represents the bond to the dye part.

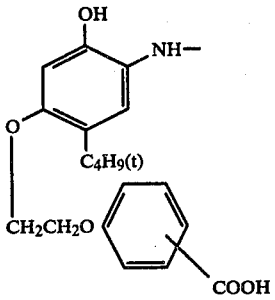
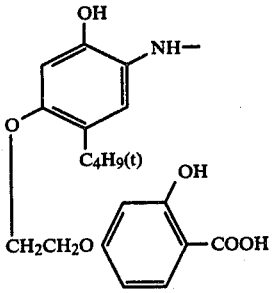
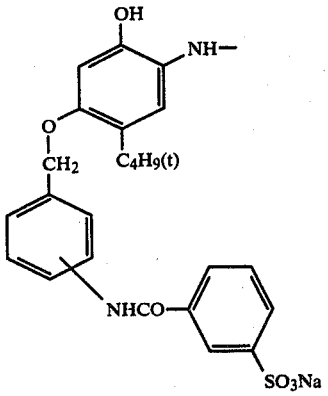
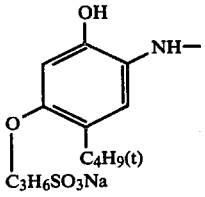
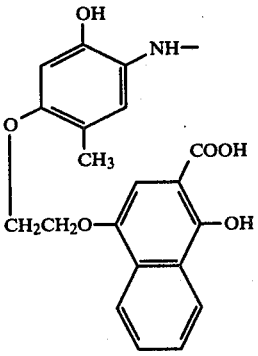
-continued
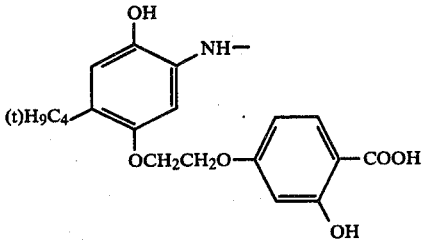
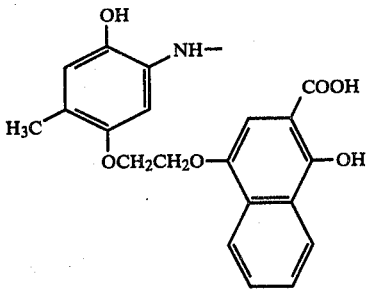
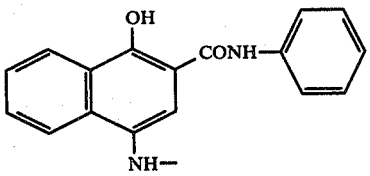
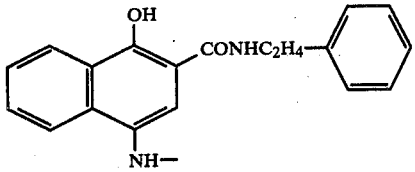
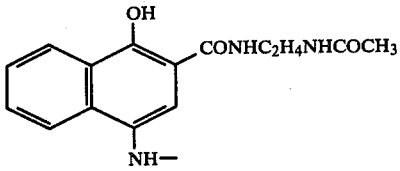
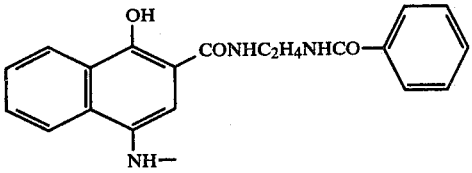
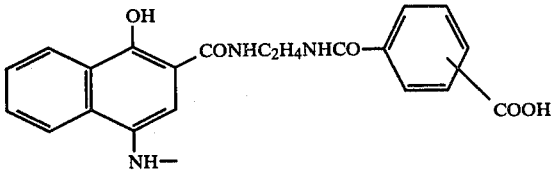
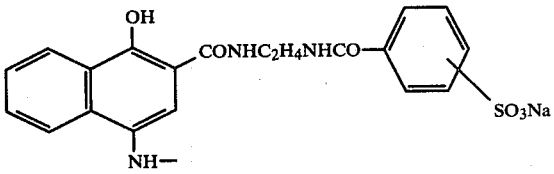

-continued

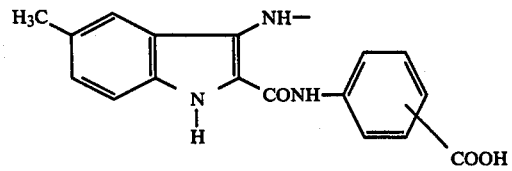

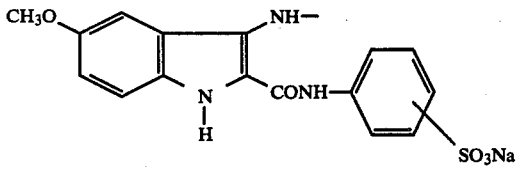

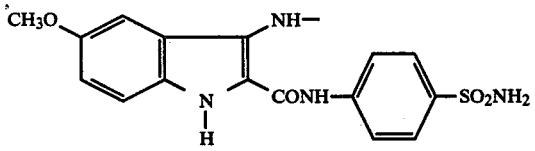

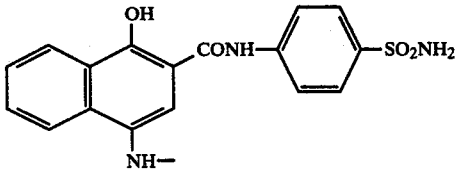

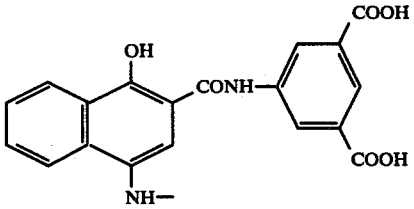

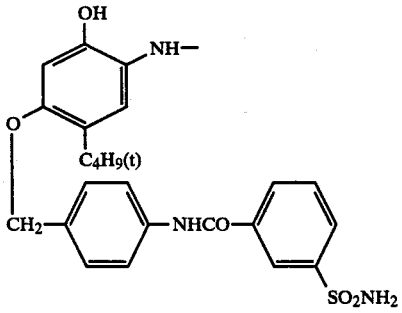

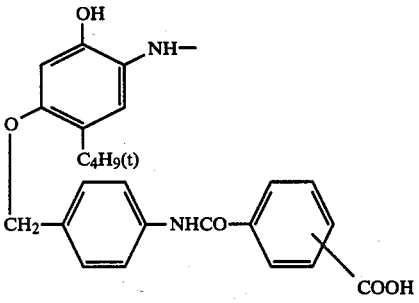

Examples of dyes which can be used for image forming dyes include azo dyes, azomethine dyes, anthraquinone dyes, naphthoquinone dyes, styryl dyes, quinophthalone dyes and phthalocyanine dyes. Preferred examples of dyes which can be used for image forming dyes include a water insoluble dye which does not contain a carboxyl group or a sulfo group. Preferred examples of them are described below and are classified by hue.

Yellow:

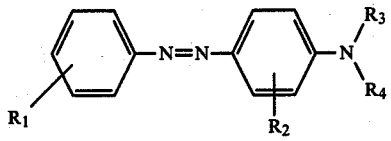

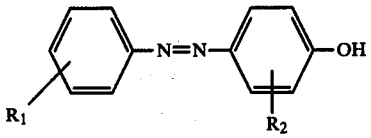

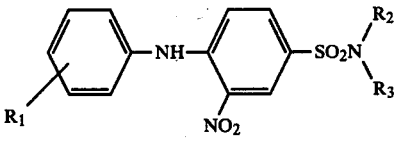

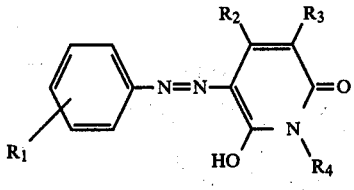

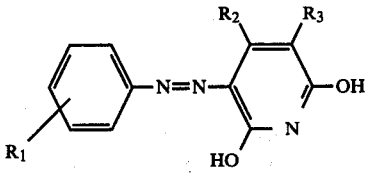

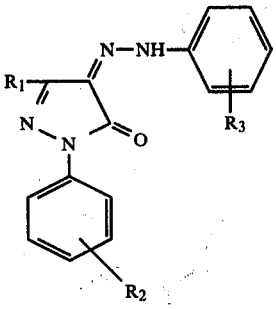

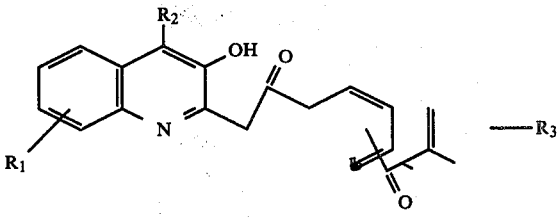

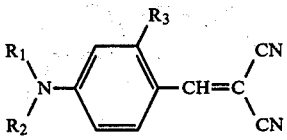

-continued
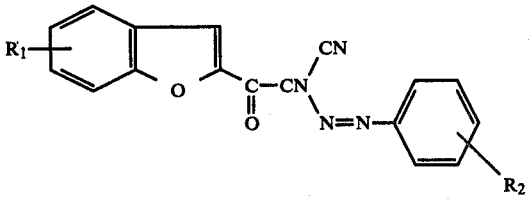
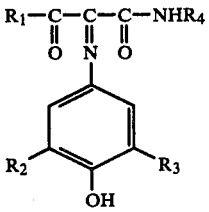
Magenta
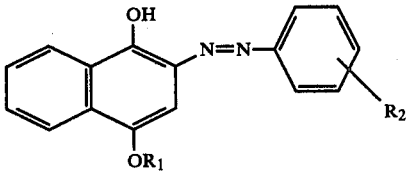
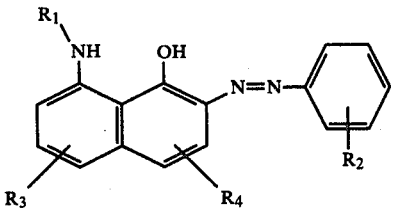
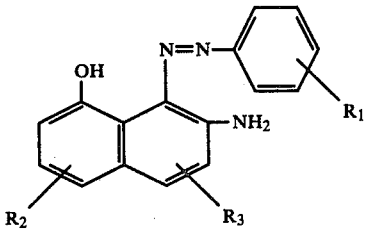
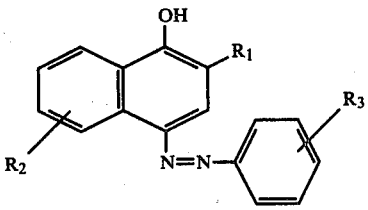
-continued
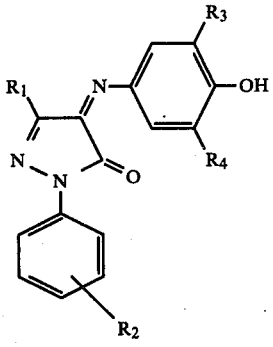
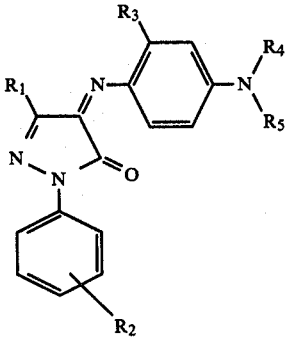
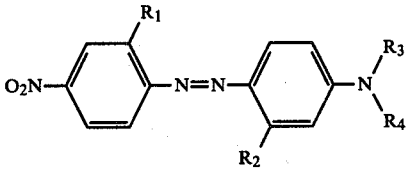
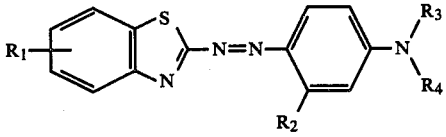
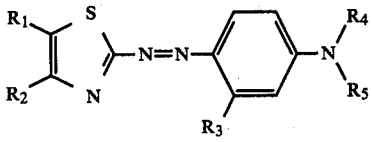
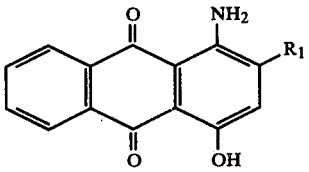
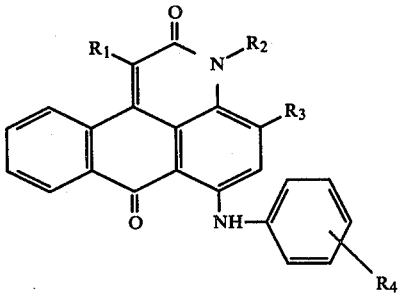

-continued

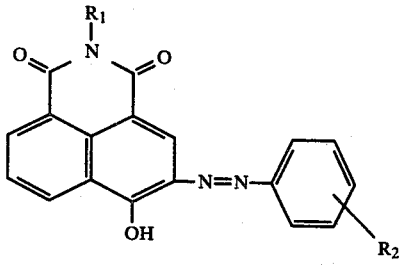

Cyan

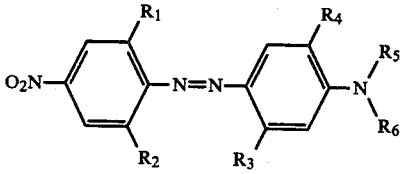

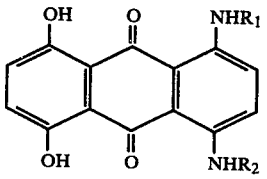

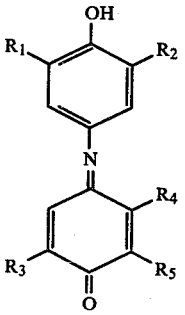

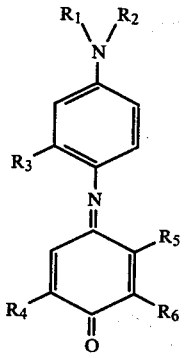

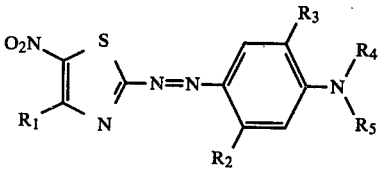

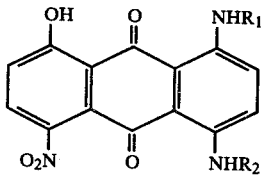

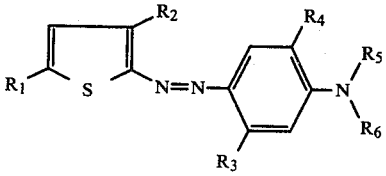

-continued

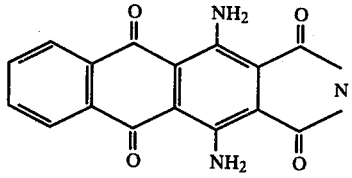

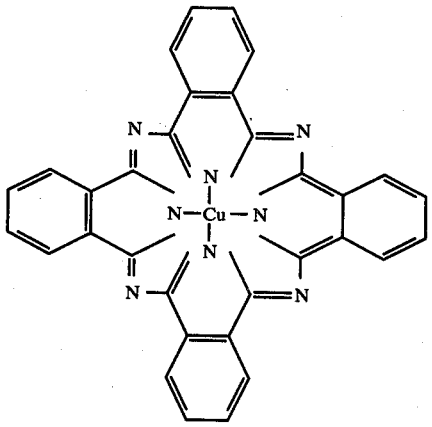

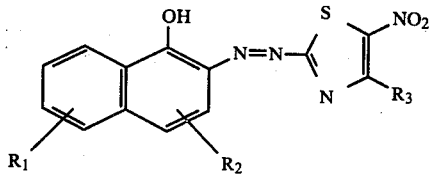

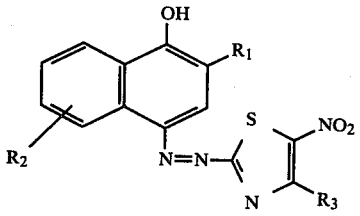

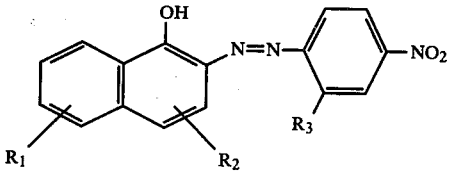

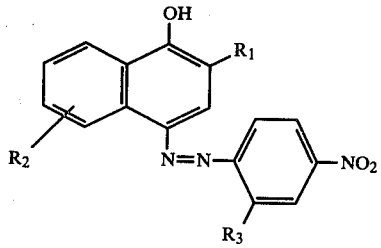

wherein $R_1$ to $R_6$ each represents a substituent selected from the group consisting of hydrogen, an alkyl group, a cycloalkyl group, an aralkyl group, an alkoxy group, an aryloxy group, an aryl group, an acylamino group, an acyl group, an cyano group, a hydroxyl group, an alkylsulfonylamino group, an arylsulfonylamino group, an alkylsulfonyl group, a hydroxyalkyl group, a cyano-alkyl group, an alkoxycarbonylalkyl group, an alkoxyalkyl group, an aryloxyalkyl group, a nitro group, a halogen, a sulfamoyl group, a N-substituted sulfamoyl group, a carbamoyl group, a N-substituted carbamoyl group, an aryloxyalkyl group, an amino group, a substituted amino group, an alkylthio group and an arylthio group. It is preferred that the number of the carbon atoms of substituent represented by $R_1$, $R_2$, $R_3$, $R_4$, $R_5$ or $R_6$ is from 1 to 8, and the total number of the carbon atoms of substituents represented by $R_1$ to $R_6$ is from 1 to 18, or $R_1$ to $R_6$ each represents hydrogen.

Characteristics required for the image forming dyes are as follows:

1. It does not have a carboxyl group or a sulfo group and has excellent heat diffusibility in the hydrophobic polymers, whereby it is effectively diffused in an image receiving layer;
2. It has a good hue;
3. It has a large molecular extinction coefficient;
4. It is fast to light and heat and stable with respect to the dye releasing activator; and
5. It is easily synthesized.

Examples of improved image forming dyes which satisfy the above described requirements are described in the following.

Yellow:

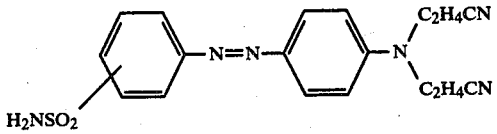

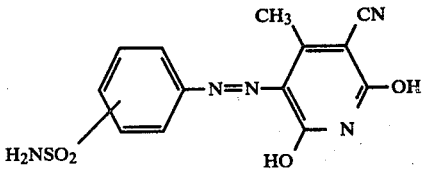

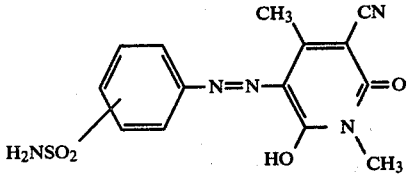

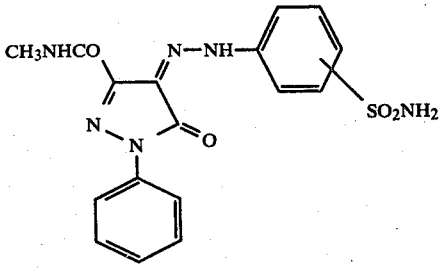

-continued

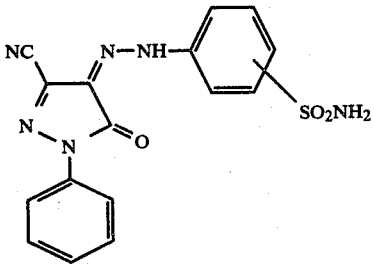

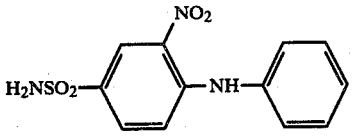

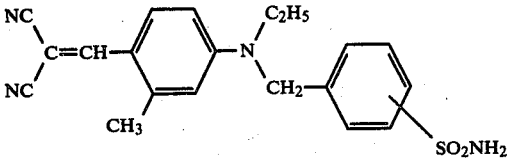

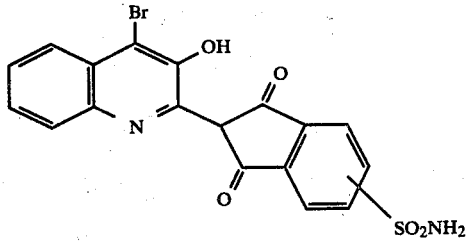

Magenta

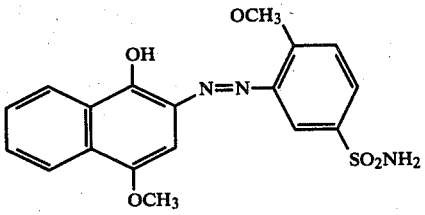

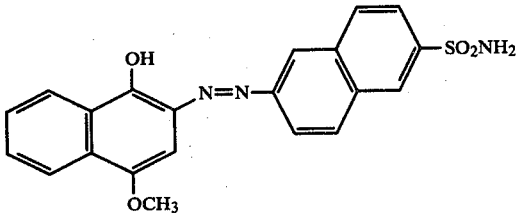

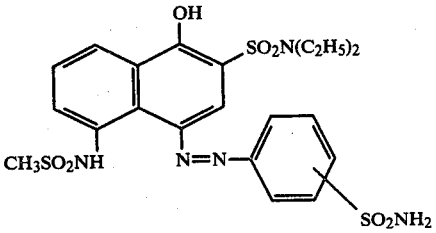

-continued
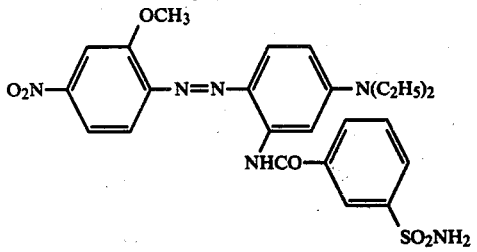
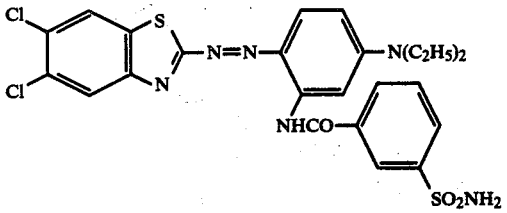
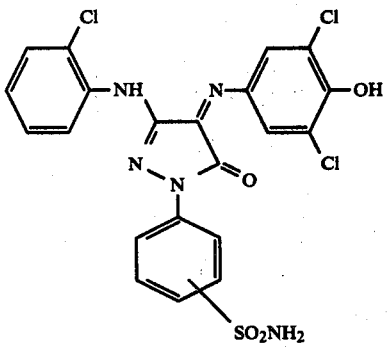
Cyan
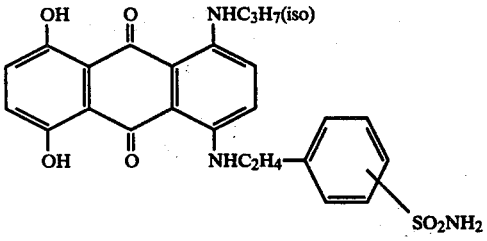
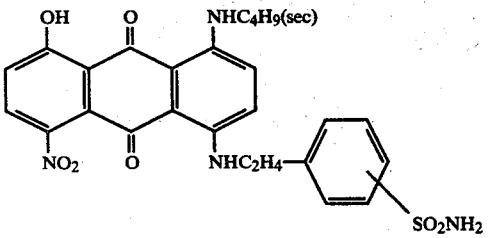
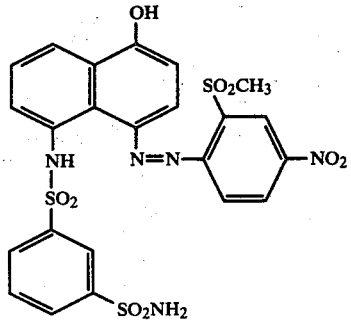
-continued
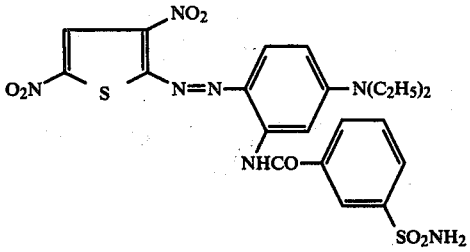
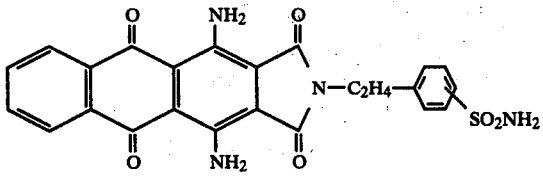
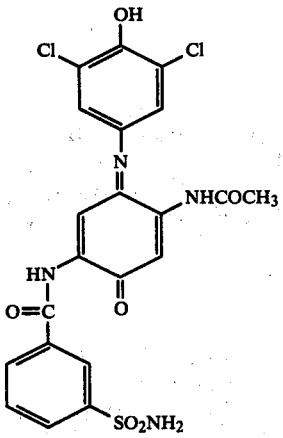
wherein the end group —$SO_2NH_2$ in these dyes represents a group necessary to bond to the reducing group R.
In the following, particular preferred examples of the dye releasing redox compounds are described.
(1)
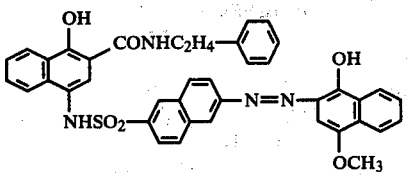
(2)
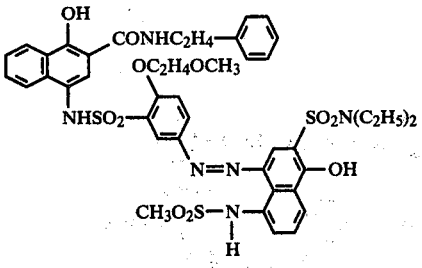

-continued
(3)
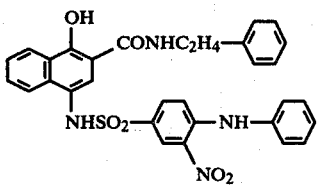
(4)
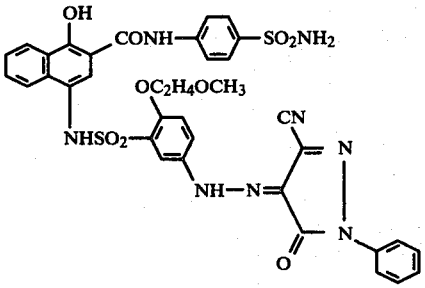
(5)
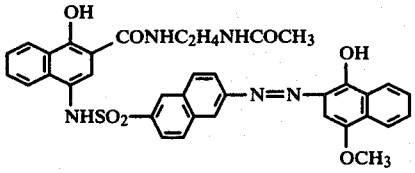
(6)
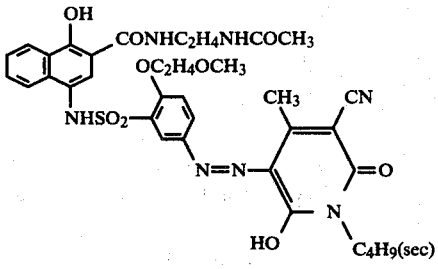
(7)
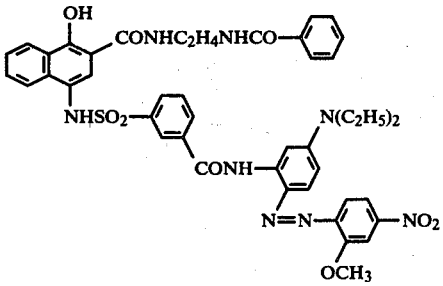
(8)
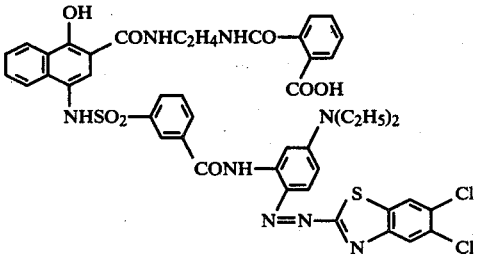
-continued
(9)
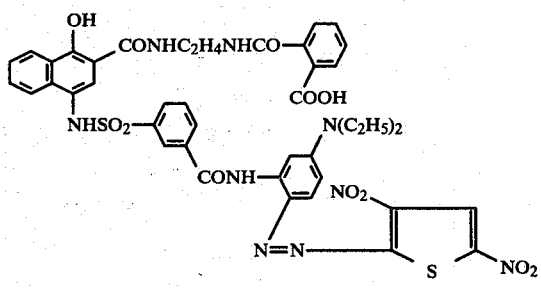
(10)
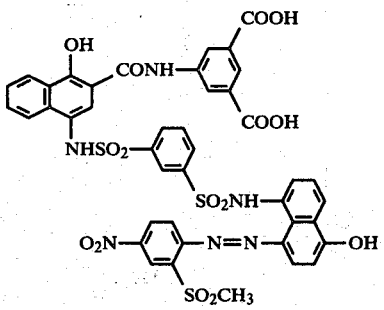
(11)
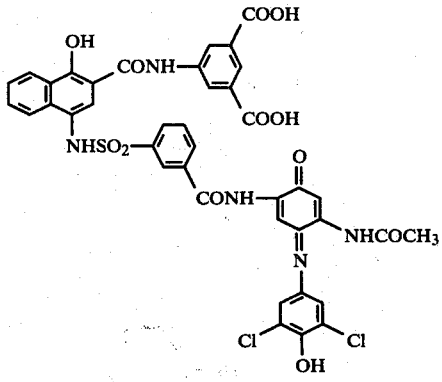
(12)
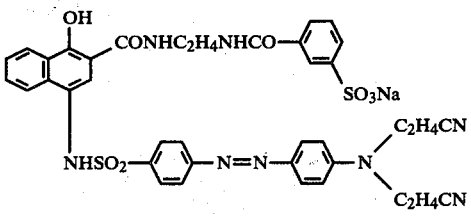
(13)
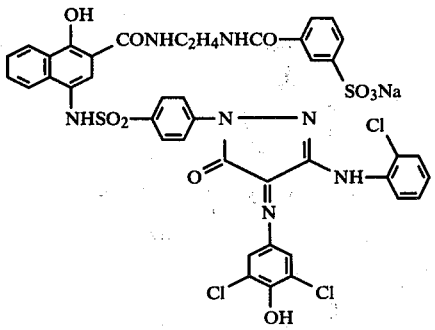

-continued
(14)
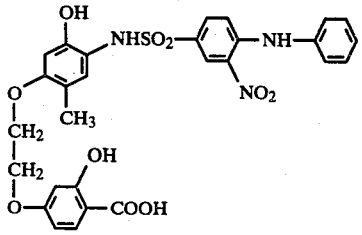
(15)
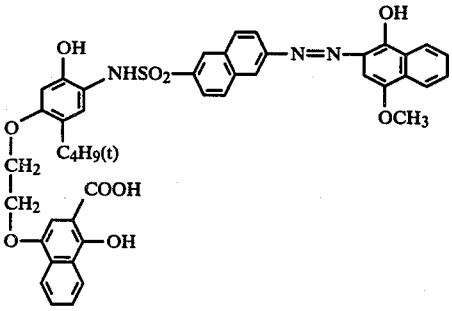
(16)
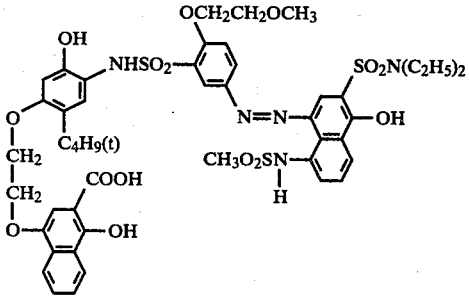
(17)
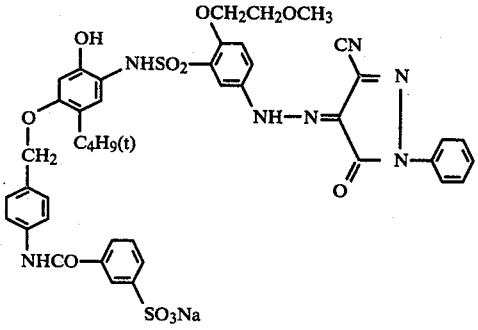
(18)
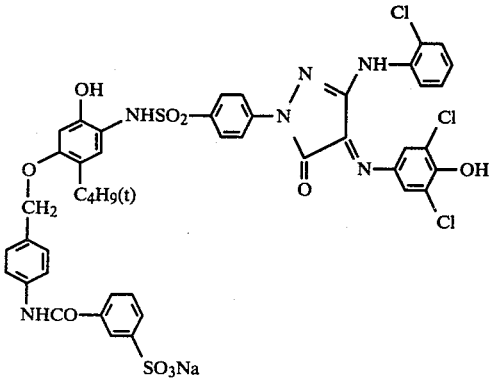
-continued
(19)
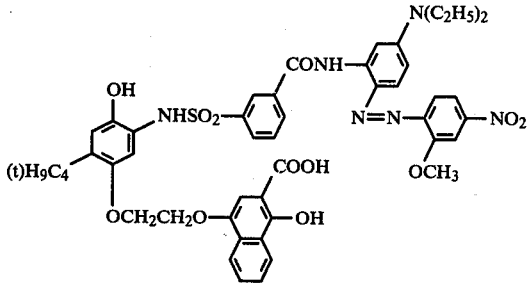
(20)
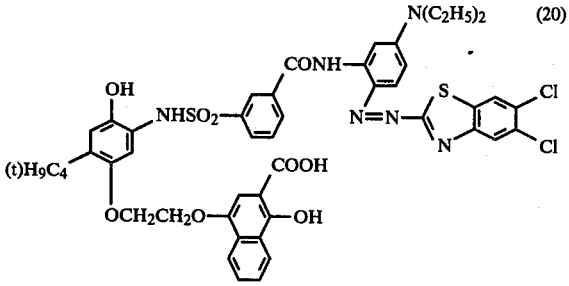
(21)
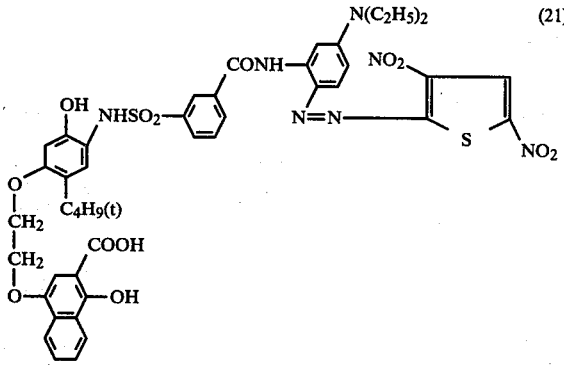
(22)
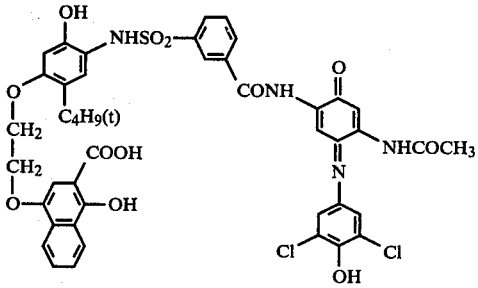
(23)
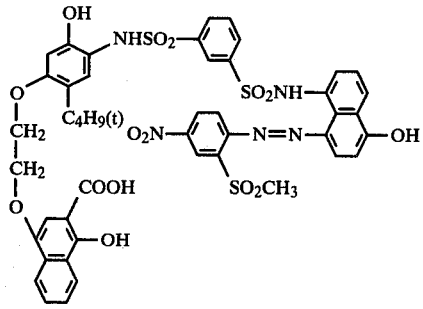

-continued

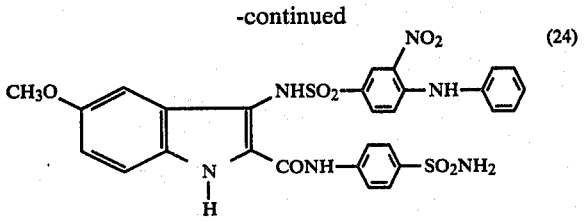

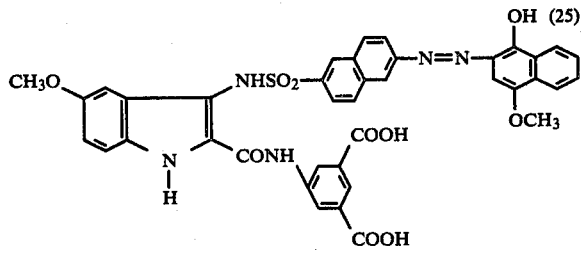

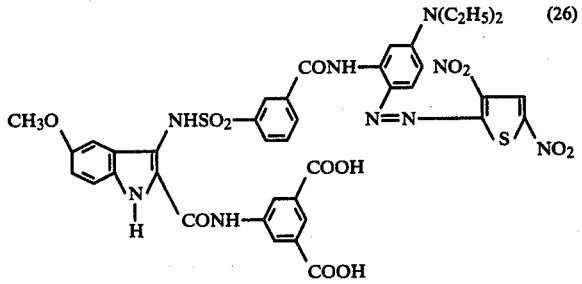

Processes for synthesizing the dye releasing redox compounds are described below.

Generally, the dye releasing redox compounds are obtained by condensing an amino group of the reducing group R with sulfonic acid chloride of the image forming dye part D.

The amino group of the reducing group R may be used as a free base or may be used as a salt of inorganic acid. Further, the sulfonic acid chloride of the dye part D is obtained by converting the corresponding sulfonic acid or salts thereof into acid chloride using an chlorinating agent such as phosphorus oxychloride, phosphorus pentachloride or thionyl chloride, etc. according to the conventional method.

The condensation of the reducing group R with the dye part D easily proceeds in a non-proton polar solvent such as dimethylformamide, dimethylacetamide, dimethylsulfoxide, N-methylpyrrolidone or acetonitrile, etc. in a presence of an organic base such as pyridine, picoline, lutidine, triethylamine or diisopropylethylamine, etc. at 0° to 50° C. and, generally, 0° to 20° C., by which the desired dye releasing redox compound can be obtained in a high yield. Examples are described below. Examples of synthesizing dye releasing redox compound:

1. Synthesis of Dye releasing Redox Compound (1)

Synthesis of 4-amino-2-(N-2-phenetylcarbamoyl)-1-naphthol (1-a).

11.64 g (0.04 mol) of 2-(N-2-phenetylcarbamoyl)-1-naphthol was dissolved in a mixture composed of 12 g of potassium hydroxide, 25 ml of water and 200 ml of methanol. To the resulted solution, an aqueous solution of diazonium salt prepared with using 5.75 g of anthranilic acid was added to 0° to 5° C. After stirred at 5° to 10° C. for 30 minutes, 100 ml of a 20% aqueous solution of potassium hydroxide was added thereto and 50 g of sodium hydrosulfite was added at 50° to 60° C. After stirring at the same temperature for 10 minutes, it was cooled with ice and neutralized with diluted hydrochloric acid. The formed light yellow precipitate was filtered off.

Yield: 11.5 g

Synthesis of 2-(6-chlorosulfonyl-2-naphthylazo)-4-methoxy-1-naphthol (1-b).

4.9 g (0.02 mol) of sodium 2-naphthylamine-6-sulfonate was diazotized with 1.38 g of sodium nitrite and 10 ml of hydrochloric acid. The resulting diazotized solution was added to a mixture composed of 3.48 g (0.02 mol) of 4-methoxy-1-naphthol, 11.2 g of potassium hydroxide, 10 ml of methanol and 30 ml of water at 0° to 5° C. After stirring at 10° to 15° C. for 30 minutes, salting-out was carried out with a saturated aqueous solution of sodium chloride. The resulting precipitate was filtered off and dried. yield: 8.6 g. The product was added to a mixture composed of 40 ml of acetonitrile and 15 ml of dimethylacetamide, and 15 ml of phosphorus oxychloride was added dropwise thereto under cooling with ice. After stirring at a room temperature for 2 hours, the reacting solution was poured into iced water and the resulting dark red precipitate was filtered off.

Yield: 6.8 g.

Synthesis of Dye Releasing Redox Compound (1):

3.06 g (0.01 mol) of 4-amino-2-(N-β-phenetyl)carbamoyl-1-naphthol was dissolved in a mixture of 5 ml of pyridine and 20 ml of dimethylacetamide. In addition, 4.27 g (0.01 mol) of 2-(6-chlorosulfonyl-2-naphthyl)azo-4-methoxy-1-naphthol (1-b) was added little by little thereto under cooling with ice. After stirring at room temperature for 30 minutes, the reacting solution was poured into cold diluted hydrochloric acid, and the resulting precipitate was filtered off. Yield: 7.0 g. The crude product was recrystallized from methyl cellosolve to obtain a purified product.

2. Synthesis of Dye Releasing Redox Compound (2)

Synthesis of 4-(3-chlorosulfonyl-4-methoxyethoxyphenylazo)-2-(N,N-diethylsulfamoyl)-5-methylsulfonyl-1-naphthol (2-b)

5.38 g (0.02 mol) of sodium 3-amino-6-methoxyethoxybenzenesulfonate was diazotized using 1.38 g of sodium nitrite and 10 ml of hydrochloric acid, followed by coupling with 7.46 g (0.02 mol) of 2-(N,N-diethylsulfamoyl)-5-methylsulfonyl-1-naphthol. The resulting dye was chlorinated in a mixture composed of acetonitrile and dimethylacetamide with phosphorus oxychloride by the same manner as in (1-b) to obtain the above described sulfonic acid chloride.

Synthesis of Dye Releasing Redox Compound (2):

3.06 g (0.01 mol) of (1-a) was dissolved in a mixture composed of 5 ml of pyridine and 20 ml of dimethylacetamide. Then, 6.49 g (0.01 mol) of (2-b) was added little by little under cooling with ice.

After stirring at room temperature for 1 hour, the reaction solution was poured into cold diluted hydrochloric acid, and the resulting orange precipitate was filtered off. Yield: 9.4 g. The product was recrystallized from ethyl acetate to obtain a purified product.

3. Synthesis of Dye Releasing Redox Compound (3)

Synthesis of 3-nitro-4-phenylaminobenzenesulfonyl chloride (3-b)

A mixture composed of 23.8 g (0.1 mol) of 4-chloro-3-nitrobenzenesulfonic acid, 28 g of aniline and 30 ml of dimethylacetamide was heated to 90° to 100° C. for 3 hours. After being allowed to cool, the reaction solution was poured into cold diluted hydrochloric acid, and the resulting yellow crystals were filtered off. The resulting salt of 3-nitro-4-phenylaminobenzenesulfonic acid was chlorinated under the same condition as in (1-b) to obtain 3-nitro-4-phenylaminobenzenesulfonyl chloride (3-b).

Synthesis of Dye Releasing Redox Compound (3):

6.12 g (0.02 mol) of (1-a) was dissolved in a mixture composed of 10 ml of pyridine and 40 ml of dimethylacetamide. Then 6.25 g (0.02 mol) of (3-b) was added little by little thereto under cooling with ice. After stirring at a room temperature for 30 minutes, the reaction solution was poured into cool diluted hydrochloric acid, and the resulting precipitate was filtered off. Yield: 11.7 g. The product was recrystallized from acetonitrile to obtain a purified product.

4. Synthesis of Dye Releasing Redox Compound (4)

Synthesis of 4-amino-2-(N-4-sulfamoylphenyl)carbamoyl-1-naphthol (4-a)

A mixture composed of 30.9 g (0.1 mol) of phenyl 1-hydroxy-4-nitro-2-naphthoate, 17.2 g of p-aminobenzenesulfonamide and 200 ml of diethylene glycol dimethyl ether was heated at 160° C. for 3 hours. After cooling, the separated yellow crystals were filtered off. Yield: 19 g. 7.74 g (0.02 mol) of the resulting yellow crystals were dissolved in 100 ml of 10% sodium hydroxide. Then 40 g of sodium hydrosulfite was added at 50° to 60° C. thereto. After stirring at the same temperature for 30 minutes, the solution was allowed to cool and neutralized with diluted hydrochloric acid. The resulting light yellow precipitate of (4-a) was filtered off. Yield: 5.3 g Synthesis of 2-cyano-1-phenyl-4-(3-chlorosulfonyl-4-methoxyphenylazo)-5-pyrazolone (4-b)

5.38 g (0.02 mol) of sodium 3-amino-6-methoxyethoxybenzenesulfonate was diazotized by the conventional method, followed by coupling with 3.70 g (0.02 mol) of 3-cyano-1-phenyl-5-pyrazolone. The resulting dye was chlorinated under the same condition as in (1-b) to obtain sulfonyl chloride (4-b).

Synthesis of Dye Releasing Redox Compound (4)

3.57 g (0.01 mol) of (4-a) was dissolved in a mixture composed of 5 ml of pyridine and 20 ml of dimethylacetamide, and 4.62 g (0.01 mol) of (4-b) was added little by little under cooling with ice. After stirring at room temperature for 30 minutes, the reaction solution was poured into cool diluted hydrochloric acid and the resulting yellowish orange precipitate was filtered. Yield: 7.7 g. The product was recrystallized from methyl cellosolve to obtain a purified product.

5. Synthesis of Dye Releasing Redox Compound (5)

Synthesis of 4-amino-2-(N-2-acetylaminoethylcarbamoyl)-1-naphthol (5-a)

To a mixture composed of 11.5 g (0.05 mol) of 2-(N-2-aminoethylcarbamoyl)-1-naphthol and 30 ml of ethyl acetate, 20 ml of acetic acid anhydride was added. The mixture was allowed to stand for 5 hours. The separated light brown crystals were filtered off. Yield: 10.6 g 8.16 g of the product was dissolved in a mixture composed of 10 g of potassium hydroxide, 100 ml of methanol and 20 ml of water, and a diazonium solution prepared from 4.38 g of anthranilic acid was added thereto at 5° to 10° C. After stirring at 10° to 15° C. for 1 hour, 100 ml of a 15% aqueous solution of potassium hydroxide was added and further 30 g of sodium hydrosulfite was added at 50° to 60° C. After stirring at the same temperature for 15 minutes, the solution was cooled and neutralized with diluted hydrochloric acid to obtain a light yellow precipitate of (5-a).

Yield: 6.9 g

Synthesis of Dye Releasing Redox Compound (5)

2.87 g (0.01 mol) of (5-a) was dissolved in a mixture composed of 5 ml of pyridine and 20 ml of dimethylacetamide. Then, 4.27 g (0.01 mol) of (1-b) was added little by little under cooling with ice. After stirring at room temperature for 30 minutes, the reaction solution was poured into diluted hydrochloric acid, and the resulting dark red precipitate of (5) was filtered off. Yield: 6.4 g. The product was recrystallized from methyl cellosolve to obtain a purified product.

6. Synthesis of Dye Releasing Redox Compound (6)

Synthesis of 1-sec-butyl-3-cyano-4-methyl-6-hydroxy-5-(3-chlorosulfonyl-4-methoxyethoxyphenylazo)-2-pyridone (6-a)

A mixture composed of 130 g (1 mol) of ethyl acetoacetate, 99 g (1 mol) of methyl cyanoacetate, 146 g (2 mol) of sec-butylamine and 300 ml of methanol was heated in an autoclave at 100° to 110° C. for 10 hours. After cooling, the reaction solution was neutralized with diluted hydrochloride to obtain white crystals of 1-sec-butyl-3-cyano-6-hydroxy-4-methyl-2-pyridone.

5.38 g (0.02 mol) of sodium 3-amino-6-methoxyethoxybenzenesulfonate was diazotized by the conventional method, followed by coupling with 4.12 g (0.02 mol) of the above described 1-sec-butyl-3-cyano-6-hydroxy-4-methyl-2-pyridone. The resulting yellow dye was chlorinated under the same condition as in (1-b) to obtain sulfonic acid chloride (6-b).

Synthesis of Dye Releasing Redox Compound (6)

2.87 g (0.01 mol) of (5-a) was dissolved in a mixture composed of 5 ml of pyridine and 20 ml of dimethylacetamide. Then, 4.83 g (0.01 mol) of (6-b) was added little by little under cooling with ice. After stirring at a room temperature for 30 minutes, the reaction solution was poured into diluted hydrochloric acid, and the resulting yellowish orange precipitate of (6) was filtered off. Yield: 7.3 g. The product was recrystallized from methyl cellosolve to obtain a purified product.

The dye releasing redox compound which releases a diffusible dye of the present invention can be used in an amount of a fixed range. Generally, a suitable range is about 0.01 mol to about 4 mols of the dye releasing redox compound per mol of the organic silver salt. A particularly suitable amount in the present invention is in a range of about 0.05 to about 1 mol per mol of the organic silver salt.

In the present invention, if necessary, a reducing agent may be used. The reducing agent in this case is the so-called auxiliary developing agent, which is oxidized by the silver salt to form its oxidized product having an ability to oxidize the reducing group R in the dye releasing redox compound.

Examples of useful auxiliary developing agents include hydroquinone, alkyl substituted hydroquinones such as tertiary butyl hydroquinone or 2,5-dimethylhydroquinone, catechols, pyrogallols, halogen substituted hydroquinones such as chlorohydroquinone or dichlorohydroquinone, alkoxy substituted hydroquinones such as methoxyhydroquinone, and polyhydroxybenzene derivatives such as methyl hydroxynaphthalene, etc. Further, there are methyl gallate, ascorbic acid, ascorbic acid derivatives, hydroxylamines such as N,N-di-(2-ethoxyethyl)hydroxylamine, etc., pyrazolidones such as 1-phenyl-3-pyrazolidone or 4-methyl-4-hydroxymethyl-1-phenyl-3-pyrazolidone, etc., reductones and hydroxy tetronic acids.

The auxiliary developing agent can be used in an amount of a fixed range. A suitable range is 0.01 times by mol of 20 times by mol based on the organic silver salt. A particularly suitable range is 0.1 times by mol of 4 times by mol.

In the heat-developable color photographic materials of the present invention, various kinds of dye releasing activator may be used. The dye releasing activator means a substance which attacks nucleophilically the dye releasing redox compound oxidized by the organic silver salt and/or silver halide to release a diffusible dye, and bases, base releasing agents and water releasing compounds are used. In these dye releasing activator, the bases and the base releasing agents are particularly preferred because they not only accelerate release of the dye but also accelerate the oxidation-reduction reaction between the organic silver salt and the dye releasing redox compound.

Examples of preferred bases are amines which include trialkylamines, hydroxylamines, aliphatic polyamines, N-alkyl substituted aromatic amines, N-hydroxyalkyl substituted aromatic amines and bis-[p-(dialkylamino)phenyl]methanes. Further, there are betaine tetramethylammonium iodide and diaminobutane dihydrochloride described in U.S. Pat. No. 2,410,644 and organic compounds including amino acids such as 6-aminocaproic acid and urea described in U.S. Pat. No. 3,506,444. The base releasing agent is a substance which releases a basic component by heating. Examples of typical base releasing agent have been described in British Pat. No. 998,949. A preferred base releasing agent is a salt of a carboxylic acid and an organic base, and examples of the suitable carboxylic acid include trichloroacetic acid and trifluoroacetic acid and examples of suitable base include guanidine, piperidine, morpholine, p-toluidine and 2-picoline, etc. Guanidine trichloroacetic acid described in U.S. Pat. No. 3,220,846 is particularly preferred. Further, aldonic amides described in Japanese Patent Application (OPI) No. 22625/75 are suitably used because they decompose at a high temperature to form a base.

The water releasing compound means a compound which releases water by decomposition during heat development to convert into a compound having a vapour pressure of $10^{-5}$ Torrs or more at a temperature of 100° to 200° C. These compounds are known in the field of printing of fabrics, and $NH_4Fe(SO_4)_2.12H_2O$, etc. described in Japanese Patent Application (OPI) No. 88386/75 are useful.

These dye releasing activators can be used in an amount of a broad range. It is preferred to use in a range of 1/100 to 10 times and, preferably, 1/20 to 2 times by molar ratio based on silver.

Further, in the heat-developable color photographic materials of the present invention, it is possible to use compounds which activate development simultaneously with stabilizing the images. Particularly, it is suitable to use isothiuroniums including 2-hydroxyethylisothiuronium, trichloroacetate described in U.S. Pat. No. 3,301,678, bis-isothiuroniums including 1,8-(3,6-dioxaoctane)-bis-(isothiuronium trifluoroacetate), etc. described in U.S. Pat. No. 3,669,670, thiol compounds described in German Patent Application (OLS) No. 2,162,714, thiazolium compounds such as 2-amino-2-thiazolium trichloroacetate, 2-amino-5-bromoethyl-2-thiazolium trichloroacetate, etc. described in U.S. Pat. No. 4,012,260, compounds having α-sulfonylacetate as an acid part such as bis-(2-amino-2-thiazolium)methylenebis(sulfonylacetate), 2-amino-2-thiazolium phenylsulfonylacetate, etc. described in U.S. Pat. No. 4,060,420, and compounds having 2-carboxycarboxamide as an acid part described in U.S. Pat. No. 4,088,496.

These compounds or mixtures thereof can be used in an amount of a broad range. It is preferable to use them in a range of 1/100 to 10 times and, preferably, 1/20 to 2 times by molar ratio based on silver.

In the heat-developable color photographic materials of the present invention, it is possible to use a thermal solvent. The term "thermal solvent" means a nonhydrolyzable organic material which is solid at an ambient temperature but melts together with other components at a temperature of thermal treatment. Preferred examples of thermal solvents include compounds which can act as a solvent for the developing agent and compounds having a high dielectric constant which accelerate physical development of silver salts. Examples of preferred thermal solvents include polyglycols described in U.S. Pat. No. 3,347,675, for example, polyethylene glycol having an average molecular weight of 1500 to 20000, derivatives of polyethylene oxide such as oleic acid ester, etc., beeswax, monostearin, compounds having a high dielectric constant which have —$SO_2$— or —CO— such as acetamide, succinimide, ethylcarbamate, urea, methylsulfonamide or ethylene carbonate, polar substances described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate described in *Research Disclosure;* p.p. 26 to 28 (December, 1976), etc.

The silver halide and organic silver salt used in the present invention are prepared in the hydrophobic polymer binder as described above or dispersed in the hydrophobic polymer binder after preparation. The hydrophobic polymer binder is composed of transparent synthetic polymers, examples of which include those described in U.S. Pat. Nos. 3,142,586, 3,193,386, 3,062,674, 3,220,844, 3,287,289 and 3,411,911. Examples of effective polymers include water insoluble polymers composed of monomers such as alkyl acrylate, alkyl methacrylate, acrylic acid, sulfoalkyl acrylate or sulfoalkyl methacrylate, etc. and polymers having cyclic sulfobetaine units as described in Canadian Pat. No. 774,054. Preferred examples of hydrophobic polymer binder include a thermoplastic polymer. Examples of more preferred polymers include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloride-vinyl acetate copolymers, vinyl chloridevinyl acetate-maleic acid copolymers, polyvinyl alcohol, polyvinyl acetate, benzyl cellulose, acetyl cellulose, cellulose propionate and cellulose acetate phthalate. Among these polymers, polyvinyl butyral, polyvinyl acetate, ethyl cellulose, polymethyl methacrylate and cellulose acetate butyrate are particularly preferred to use. If necessary, two or more of them may be used as a mixture. The amount of the hydrophobic polymer binder is in the range of about 1/10 to 10 times and, preferably, ¼ to 4 times by weight ratio based on the organic silver salt.

The support used in the present invention is that which can endure at the processing temperature. Examples of useful common supports include not only glass, paper, metal and analogues thereof, but also acetyl cellulose films, cellulose ester films, polyvinyl acetal films, polystyrene films, polycarbonate films, polyethylene terephthalate films and films related to them and plastic materials. Polyesters described in U.S. Pat. Nos. 3,634,089 and 3,725,070 are suitably used. Polyethylene terephthalate films are particularly preferred.

A concrete process for forming color images by development in the present invention is the thermal diffusion transfer process for mobile dyes. The heat-developable color photographic materials used for such a process comprising a support having coated thereon a photosensitive layer (I) containing at least a silver halide, an organic silver salt and a reducing agent thereof, a dye releasing redox compound and a polymer binder provided on a base and an image receiving material (II) capable of receiving a mobile dye formed on the layer (I).

The above described photosensitive layer (I) and the image receiving material (II) may be formed on the same base, or they may be formed on different bases, respectively. The image receiving material (II) can be stripped off the photosensitive layer (I). For example, after the heat-developable color photographic material is exposed imagewise to light, it is developed by heating uniformly and thereafter the image receiving material is peeled apart.

In accordance with another process, after the heat-developable color photographic material is exposed imagewise to light, the photosensitive layer (I) can be developed by heating uniformly by putting the image receiving material (II) on the photosensitive layer. Further, after the heat-developable color photographic material is exposed imagewise to light and developed by heating uniformly, the dye can be transferred on the image receiving layer (II) by putting the image receiving material thereon and heating to a temperature lower than the developing temperature.

The image receiving material (II) contains a dye mordant. In the present invention, various mordants can be used, and a useful mordant can be selected according to properties of the dye, conditions for transfer, and other components contained in the photographic material, etc. Useful mordants are polymers containing ammonium salt groups which are described in U.S. Pat. No. 3,709,690. An example of useful polymers containing ammonium salt groups is poly(styrene-co-N,N,N-tri-n-hexyl-N-vinylbenzylammonium chloride) wherein the ratio of styrene and vinyl benzylammonium chloride is about 1:4 to about 4:1 and, preferably, 1:1. Typical diffusion transfer photographic materials are obtained by mixing the polymer containing ammonium salt groups with gelatine and applying the mixture to a transparent support. The transfer of dyes on the heat-developable color photographic layer to the image receiving layer can be carried out using a transfer solvent. As the transfer solvent, it is possible to use solvents having a low boiling point such as methanol, N,N-dimethylformamide, ethyl acetate or diisobutyl ketone, etc. and solvents having a high boiling point such as tri-n-cresylphosphate, tri-n-nonyl phosphate or di-n-butyl phthalate, etc. When using solvents having a high boiling point, they can be added to the mordant layer by emulsifying in gelatine using a suitable emulsifier. In another process, a layer of titanium dioxide dispersed in gelatine can be provided on the mordant layer on the transparent support. The layer of titanium dioxide forms a white or opaque layer, by which reflection color images of the transferred color images which are observed through the transparent support are obtained.

In the present invention, though it is not necessary to incorporate substances or dyes for preventing irradiation or halation in the photosensitive materials, because the photographic materials are colored by the dye releasing redox compound, it is possible to add light absorbent materials such as filter dyes, etc. described in Japanese Patent Publication No. 3692/73 and U.S. Pat. Nos. 3,253,921, 2,527,583 and 2,956,879 in order to improve sharpness. It is preferred that these dyes have a thermally bleaching property. For example, dyes described in U.S. Pat. Nos. 3,769,019, 3,745,009 and 3,615,432 are preferred.

The photographic materials according to the present invention may contain, if necessary, various additives known for the heat-developable photographic materials and may have an antistatic layer, an electrically conductive layer, a protective layer, an intermediate layer, an AH layer and a strippable layer, etc. Examples of additives include those described in *Research Disclosure* No. 17029, Vol. 170 (June, 1978), for example, plasticizers. dyes for improving sharpness, AH dyes, sensitizing dyes, matting agents, surface active agents, fluorescent whitening agents and agents for preventing discoloration, etc.

The protective layer, the intermediate layer, the subbing layer, the back layer and other layers can be produced by preparing each coating solution and applying to the base by various coating method such as a dip coating method, an air-knife coating method, a curtain coating method or a hopper coating method described in U.S. Pat. No. 3,681,294 and drying, likewise the case of the heat-developable photographic layer of the present invention, by which the photographic material is obtaind.

If necessary, two or more layers may be applied at the same time by the method described in U.S. Pat. No. 2,761,791 and British Pat. No. 837,095.

For the heat-developable photographic materials of the present invention, various means for exposing to light can be used. Latent images are obtained by imagewise exposure by radiant rays including visible rays. Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

As the original, not only line drawings but also photographs having gradation may be used. Further, it is possible to take a photograph of a portrait or landscape by means of a camera. Printing from the original may be carried out by contact printing by putting the original so as to closely contact therewith or may carried out by reflection printing or enlargement printing.

It is also possible to carry out the printing of images photographed by a videocamera or image informations sent from a television broadcasting station by displaying on a cathode ray tube (CRT) or a fiber optical tube (FOT) and forcusing the resulting image on the heat-developable photographic material by contacting therewith or by means of a lens.

Recently, LED (light-emitting diode) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to release a yellow dye, a magenta dye and a cyan dye, respectively.

The photographic material is produced using a construction such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing. The so-called image treatment, and resulting image information is reproduced on CRT which can be utilized as an imagelike light source or lights are emitted by three kinds of LED according to the processed information.

After the heat-developable color photographic element is exposed to light, the resulting latent image can be developed by heating the entire element to a suitably elevated temperature, for example, about 80° C. to about 250° C. for about 0.5 seconds to about 300 seconds. A higher temperature or lower temperature can be utilized to prolong or shorten the heating time, if it is within the above described range. Particularly, a temperature range of about 110° C. to about 160° C. is useful. As the heating means, a simple heat plate, iron, heat roller or analogues thereof may be used.

EXAMPLE 1

A silver benzotriazole emulsion containing photosensitive silver bromide was produced as follows.

| | | |
|---|---|---|
| (A) | Benzotriazole | 12 g |
| | Isopropyl alcohol | 200 ml |
| (B) | $AgNO_3$ | 17 g |
| | $H_2O$ | 50 ml |
| (C) | LiBr | 2.1 g |
| | Ethanol | 20 ml |

Solution B was added to Solution A with stirring at 40° C. Solution A became cloudy and silver salt of benzotriazole was formed.

To the resulting solution, Solution C was added, by which silver was supplied from silver benzotriazole to convert a part of silver benzotriazole into silver bromide.

The resulting crystals were filtered off and added to a polymer solution prepared by dissolving 20 g of polyvinyl butyral in 200 ml of isopropyl alcohol, followed by dispersing for 30 minutes by a homogenizer.

10 g of the above described silver benzotriazole emulsion containing photosensitive silver bromide was added to a solution prepared by dissolving 0.35 g of dye releasing redox compound (1) having the following formula:

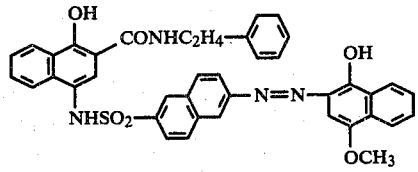

and 0.22 g of guanidine trichloroacetate in a mixture of 4 ml of ethyl alcohol, 4 ml of ethyl acetate and 2 of N,N-dimethylformamide, and the resulting mixture was stirred. The resulting mixture was applied to a polyethylene terephthalate film so as to result in a wet film thickness of 100 μm. After the resulting photographic material was dried, it was imagewise exposed at 2000 luxes for 100 seconds using a tungsten lamp. This imagewise exposed sample was put on an image receiving sheet containing a mordant wet with tributyl phosphate and heated uniformly for 30 seconds on a heat block heated to 160° C.

The image receiving sheet used here is comprised of a transparent polyethylene terephthalate film, a dye mordant layer on said film, and a titanium dioxide layer as a top layer. The mordant was the polymer containing quaternary ammonium groups which is a 1:1 copolymer of styrene and N,N,N-tri-n-hexyl-N-vinylbenzylammonium chloride.

By carrying out the above described operation, a magenta negative image was obtained on the image receiving sheet. When the density of the magenta negative image was measured by a Macbeth reflection densitometer (RD-219), the maximum reflection density to green light was 1.85 and the minimum density was 0.33.

EXAMPLE 2

Instead of the silver benzotriazole emulsion containing photosensitive silver bromide in Example 1, a silver 3-amino-5-benzylthio-1,2,4-triazole emulsion containing photosensitive silver iodide was prepared by the following process.

20.6 g of 3-amino-5-benzylthio-1,2,4-triazole was dissolved in a mixture of 200 ml of isopropyl alcohol and 200 ml of butyl acetate. To the resulting solution, a solution prepared by dissolving 17 g of silver nitrate in 100 ml of water was added with stirring.

The formed precipitate of 3-amino-5-benzylthio-1,2,4-triazole silver salt was filtered off and added to a polymer solution prepared by dissolving 20 g of polyvinyl butyral in 200 ml of isopropyl alcohol.

The resulting dispersion was dispersed for 20 minutes at 800 rpm by a homogenizer. To the resulting dispersion, a solution prepared by dissolving 2.1 g of LiI in 20 ml of ethanol was added to form AgI on a part of 3-amino-5-benzylthio-1,2,4-triazole silver salt.

A photographic material was prepared by the same procedure as in Example 1 except that 10 g of the above described emulsion was used, and the same operation was carried out. As a result, a magenta negative image was obtained on the image receiving sheet. The magenta negative density was the maximum density of 1.70 as the reflection density to green light and the minimum density of 0.28.

EXAMPLE 3

Instead of the silver benzotriazole emulsion containing photosensitive bromide in Example 1, a silver behenate emulsion containing photosensitive silver bromide was used.

The silver behenate emulsion containing photosensitive silver bromide was prepared as follows.

340 g of behenic acid was added to 5000 ml of water and dissolved by heating to 85° C. with stirring. To the resulting solution, an aqueous solution containing 20 g of sodium hydroxide in 500 ml of water was added at a rate of 100 ml per minute.

The resulting solution was cooled to 30° C., and a solution prepared by dissolving 85 g of silver nitrate in 500 ml of water was added to the above described solution at a rate of 100 ml per minute. The mixture was stirred at 30° C. for 90 minutes.

To the resulting solution, a solution prepared by dissolving 40 g of polyvinyl butyral in a mixture of 500 ml of butyl acetate and 500 ml of isopropyl alcohol was added, and the resulting mixture was allowed to stand. After being allowed to stand, the liquid phase part was removed, and the solid phase part was subjected to centrifugal separation (at 3000 rpm for 30 minutes).

To the solid phase part, 40 ml of isopropyl alcohol was added. The mixture was stirred for 10 minutes, and thereafter blended with a solution prepared by dissolving 270 g of polyvinyl butyral in 800 ml of isopropyl alcohol. The mixture was dispersed at 8000 rpm for 30 minutes by a homogenizer. While keeping the resulting solution at 50° C., 160 ml of acetone containing 4.2% by weight of N-bromosuccinimide was added thereto to react for 60 minutes, by which silver bromide was formed on part of the silver behenate.

A photographic material was prepared by the same procedure as in Example 1, except that 10 g of the above described silver behenate emulsion containing photosensitive silver bromide, and the same operation was carried out. As a result, a magenta negative image was obtained on the image receiving sheet. The magenta negative density was the maximum density of 0.94 as the reflection density to green light and the minimum density of 0.44.

EXAMPLE 4

The same procedure as in Example 1 was carried out, except that dye releasing redox compound (9) having the following formula:

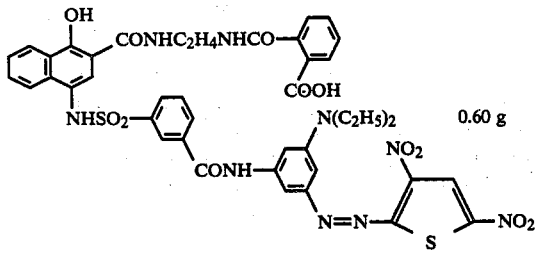

was used instead of dye releasing redox compound (1) in Example 1. As a result, a cyan negative image was obtained on the image receiving sheet. The maximum density was 1.95 as a reflection density to red light and the minimum density was 0.40.

EXAMPLE 5

The same procedure as in Example 1 was carried out, except that dye releasing redox compound (3) having the following formula:

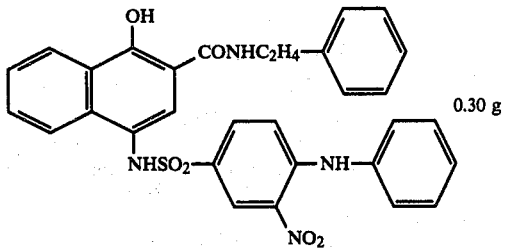

was used instead of dye releasing redox compound (1). As a result, a yellow negative image was obtained on the image receiving sheet. The maximum density was 1.10 as a reflection density to blue light and the minimum density was 0.25. Further, the gradation of the sensitometric curve was a density different of 0.70 to an exposure difference of 10 times in the straight line part.

EXAMPLE 6

To 10 g of silver benzotriazole containing photosensitive silver halide in Example 1, a solution prepared by dissolving 0.35 g of dye releasing redox compound (1), 0.22 g of guanidine trichloroacetate and 1.0 g of polyethylene glycol having a molecular weight of 2000 in a mixture of 4 ml of ethyl alcohol, 4 ml of ethyl acetate and 2 ml of N,N-dimethylformamide was added, and the mixture was stirred. Thereafter, the above described mixture was applied to a polyethylene terephthalate film resulting in a wet film thickness of 100 μm. After being dried, the photographic material was exposed imagewise at 2000 luxes for 100 seconds using a tungsten lamp. The imagewise exposed photographic material was put on the same image receiving sheet as in Example 1 and heated uniformly for about 30 seconds on a heat block heated to 160° C. As a result, a magenta negative image was obtained on the image receiving sheet. The maximum density was 1.60 as a reflection density to green light and the minimum density was 0.35.

EXAMPLE 7

A photographic material was formed by the same procedure as in Example 1. This photographic material was exposed imagewise to light for 100 seconds by a 2000 lux tungsten lamp, and thereafter it uniformly heated for about 30 seconds on a heat block heated to 160° C. After this photographic material was cooled to room temperature, it was put on the same image receiving sheet as in Example 1 and wet with methanol to closely contact therewith at a room temperature for 30 seconds. As a result, a negative magenta image was formed on the image receiving sheet. The maximum density was 1.55 as a reflection density to green light, and the minimum density was 0.30.

While the invention has been described in detail and with reference to specific embodiments thereof, it will be apparent to one skilled in the art that various changes and modifications can be made therein without departing from the spirit and scope thereof.

What is claimed is:

1. A diffusion transfer heat-developable color photographic material comprising a support having coated thereon at least a photosensitive silver halide, an organic silver salt, a hydrophobic binder, a dye releasing activator and a dye releasing redox compound which can reduce the organic silver salt and/or silver halide and release a diffusible dye represented by the following general formula (I):

$$R—SO_2—D \quad (I)$$

wherein R represents a reducing group capable of being oxidized by the organic silver salt and/or silver halide and wherein R has a hydrophilic group, and D represents an image forming dye part and does not have a carboxyl group or a sulfo group.

2. A heat-developable color photographic material as claimed in claim 1, further characterized by containing a reducing agent for the organic silver salt and/or silver halide.

3. A heat-developable color photographic material as claimed in claim 1, wherein the reducing group R in the dye releasing redox compound: $R—SO_2—D$ in claim 1 has a reduction-oxidation potential to a saturation calomel electrode of 1.2 V or less.

4. A heat-developable color photographic material as claimed in claim 1, wherein the reducing group R in the dye releasing redox compound: $R—SO_2—D$ in claim 1 is represented by the following general formulae (II) to (IX):

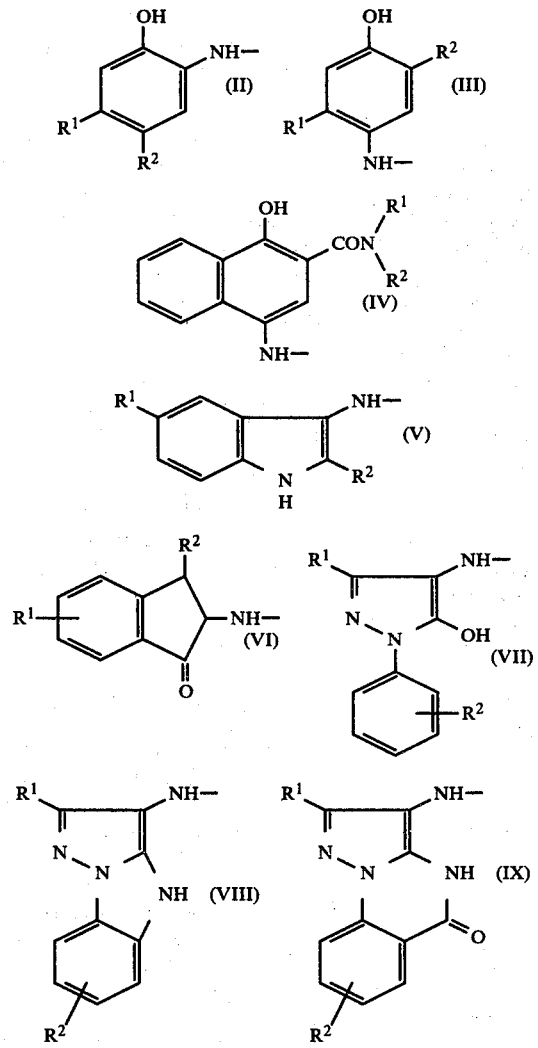

wherein $R^1$ and $R^2$ each represents a substituent selected from the group consisting of hydrogen, an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, a N-substituted carbamoyl group and a N-substituted sulfamoyl group, which may be substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

5. A heat-developable color photographic material as claimed in claim 1, wherein the dye releasing activator is a base, a base releasing agent or a water releasing compound.

6. A heat-developable color photographic material as claimed in claim 2, wherein reducing agent produces an oxidized product capable of oxidizing the reducing group R in claim 5 of $R—SO_2—D$.

7. A heat-developable color photographic material as claimed in claim 1, wherein the dye part D of the dye releasing redox compound ($R—SO_2—D$) is selected from azo dyes, azomethine dyes, anthraquinone dyes, naphthoquinone dyes, nitro dyes, styryl dyes, quinophthalone dyes, triphenylmethane dyes and phthalocyanine dyes.

8. A heat-developable color photographic material as claimed in claim 6, wherein the D part of the dye releasing redox compound is a water insoluble dye.

9. A heat-developable color photographic material as claimed in claim 1, wherein the organic silver salt is a silver salt of carboxylic acid derivatives or N containing heterocyclic compounds.

10. A heat-developable color photographic material as claimed in claim 1, wherein the binder is a thermoplastic polymer.

11. A heat-developable color photographic material as claimed in claim 5, wherein the base releasing agent is guanidine trichloroacetate.

12. A heat-developable color photographic material as claimed in claim 2, wherein a dye released from the dye releasing redox compound is thermally transferred on the image receiving material.

13. A heat-developable color photographic material as claimed in claim 1, characterized by containing additionally a silver salt stabilizer.

14. A heat-developable color photographic material as claimed in claim 1, further comprising a thermal solvent.

15. A process for forming a color image which comprises heating a diffusion transfer heat-developable color photographic material, wherein said color photographic material comprises a support having coated thereon at least a photosensitive silver halide, an organic silver salt, a hydrophobic binder, a dye releasing activator and a dye releasing redox compound which can reduce the organic silver salt and/or silver halide and release a diffusible dye represented by the following general formula (I):

$$R—SO_2—D \quad (I)$$

wherein R represents a reducing group capable of being oxidized by the organic silver salt and/or silver halide and wherein R has a hydrophilic group, and D represents an image forming dye part and does not have a carboxylic group or a sulfo group, after the exposure of said color photographic material to light to imagewise release the diffusible dye, to transfer the diffusible dye by said heating, and thereafter fixing said diffusible dye on an image receiving material.

* * * * *